US008947181B2

(12) United States Patent
Malingowski et al.

(10) Patent No.: US 8,947,181 B2
(45) Date of Patent: Feb. 3, 2015

(54) ARC RUNNER ASSEMBLY AND CIRCUIT INTERRUPTER

(71) Applicant: Eaton Corporation, Cleveland, OH (US)

(72) Inventors: Richard Paul Malingowski, McDonald, PA (US); James Patrick Sisley, Baden, PA (US); Craig Joseph Puhalla, Moon Township, PA (US); Kelly Julia McCarthy, Pittsburgh, PA (US); Lance Gula, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 211 days.

(21) Appl. No.: 13/677,631

(22) Filed: Nov. 15, 2012

(65) Prior Publication Data

US 2014/0131317 A1 May 15, 2014

(51) Int. Cl.

| | |
|---|---|
| ***H01H 75/00*** | (2006.01) |
| ***H01H 33/20*** | (2006.01) |
| ***H01H 9/46*** | (2006.01) |
| ***H01H 73/18*** | (2006.01) |

(52) U.S. Cl.

CPC ..... *H01H 33/20* (2013.01); *H01H 9/46* (2013.01); *H01H 73/18* (2013.01)

USPC ..... 335/6; 218/32; 335/16; 335/201

(58) Field of Classification Search

CPC ..... H01H 33/187; H01H 2071/249

USPC ..... 218/32–33; 335/16, 201–202, 6

See application file for complete search history.

(56) References Cited

U.S. PATENT DOCUMENTS

| | | | | | |
|---|---|---|---|---|---|
| 4,546,337 | A * | 10/1985 | Petrie et al. | ..... | 335/16 |
| 4,654,490 | A * | 3/1987 | Leone et al. | ..... | 218/33 |
| 4,654,491 | A * | 3/1987 | Maier et al. | ..... | 218/33 |
| 4,689,588 | A * | 8/1987 | Murata et al. | ..... | 335/201 |
| 4,970,481 | A * | 11/1990 | Arnold et al. | ..... | 335/6 |
| 5,596,184 | A * | 1/1997 | Mitsuhashi et al. | ..... | 218/32 |
| 5,686,712 | A | 11/1997 | Weber | | |
| 7,830,232 | B2 * | 11/2010 | Grahor et al. | ..... | 335/201 |
| 8,049,126 | B2 * | 11/2011 | Chen et al. | ..... | 200/400 |
| 2004/0227603 | A1 * | 11/2004 | Ciarcia et al. | ..... | 335/202 |
| 2009/0200271 | A1 * | 8/2009 | Chen et al. | ..... | 218/148 |

FOREIGN PATENT DOCUMENTS

EP 0 255 016 A1 2/1988

OTHER PUBLICATIONS

European Patent Office, "International Search Report and Written Opinion", Nov. 21, 2013, 8 pp.

* cited by examiner

*Primary Examiner* — Truc Nguyen

(74) *Attorney, Agent, or Firm* — Eckert Seamans Cherin & Mellott, LLC; Brij K. Agarwal

(57) ABSTRACT

An arc runner assembly for use in a circuit interrupter provides a pair of arc runners that are situated at opposite sides of a stationary contact of the circuit interrupter. If used in a DC application, the arc runner assembly is configured to communicate a positive DC arc along one of the arc runners in a first direction away from the stationary contact and is further configured to communicate a negative DC arc along the other arc runner in another direction away from the stationary contact. The arc runner assembly additionally includes a support that is electrically engaged with a conductor of the circuit interrupter on a surface opposite that on which the stationary contact is disposed. The improved arc runner assembly advantageously facilitates extinction of electrical arc and extinguishes both positive and negative DC arcs in a DC application.

20 Claims, 4 Drawing Sheets

ARC RUNNER ASSEMBLY AND CIRCUIT INTERRUPTER

BACKGROUND OF THE INVENTION

1. Field

The disclosed and claimed concept relates generally to circuit interrupters and, more particularly, to an arc runner assembly for use in a circuit interrupter, as well as to a circuit interrupter.

2. Related Art

Circuit interrupters are known for use in numerous applications. Circuit interrupters are employed, for example, to open a portion of a protected circuit in certain predefined circumstances, such as might include predefined overcurrent and under-voltage circumstances, as well as other circumstances.

As is generally understood in the relevant art, a circuit interrupter typically includes a set of separable contacts that are electrically interposed between line and load conductors, and the separable contacts can be separated from one another in order to open the portion of the protected circuit to which the line and load conductors are connected. Since an electrical arc is typically formed between the contacts during their initial separation, and since such an electrical arc can be destructive to the circuit interrupter and to the protected circuit, such electrical arcs are desirably extinguished as soon as possible, and circuit interrupters typically employ some type of apparatus or system to extinguish such arcs. One type of arc extinction system includes an arc chute that includes a plurality of arc plates that are divergently oriented and which are configured to break up and extinguish an arc. An arc runner typically is employed adjacent a stationary contact of the set of separable contacts to direct the arc toward the arc chute. Any of a wide variety of devices can be employed to help move the arc in the direction of the arc chute, and these can include devices that generate magnetic fields which push the arc toward the arc chute, devices that generate gases in the presence of an arc that push the arc toward the arc chute, and the like.

While such arc extinction systems have been generally effective for their intended purposes, they have not been without limitation. For example, many of the known arc extinction systems have been developed for use in AC applications wherein an arc often lasts for at most only one-half of a cycle. Such arc extinction systems are typically not directly applicable to DC applications since a DC arc can exist for longer period of time. Moreover, whereas the voltage in AC varies between positive and negative according to a known cycle, DC is typically either positive or negative and, depending upon the application, a protected DC circuit may at different times experience either positive voltage or negative voltage. A circuit interrupter that is intended to protect a DC circuit therefore desirably has the capability to interrupt both positive DC and negative DC at given current level in. Furthermore, certain applications such as photovoltaic applications have required successively greater and greater current interruption capabilities. It thus would be desirable to provide solutions that address such shortcomings in the art.

SUMMARY OF THE INVENTION

An improved arc runner assembly for use in a circuit interrupter provides a pair of arc runners that are situated at opposite sides of a stationary contact of the circuit interrupter. If used in a DC application, the arc runner assembly is configured to communicate a positive DC arc along one of the arc runners in a first direction away from the stationary contact and is further configured to communicate a negative DC arc along the other arc runner in another direction away from the stationary contact. The arc runner assembly additionally includes a support that is electrically engaged with a conductor of the circuit interrupter on a surface opposite that on which the stationary contact is disposed. The improved arc runner assembly advantageously facilitates extinction of electrical arc and extinguishes both positive and negative DC arcs in a DC application.

Accordingly, an aspect of the disclosed and claimed concept is to provide an improved arc runner assembly for use in a circuit interrupter to extinguish electrical arcs.

Another aspect of the disclosed and claimed concept is to provide an improved arc runner assembly which, if used in a DC application, extinguishes both positive and negative DC arcs.

Another aspect of the disclosed and claimed concept is to provide an improved circuit interrupter that employs such an arc runner assembly.

These and other aspects of the disclosed and claimed concept are provided by an improved arc runner assembly that is structured for use in a circuit interrupter having a first conductor, a second conductor, and a set of separable contacts electrically interposed between the first conductor and the second conductor. The set of separable contacts include a stationary contact situated on one of the first conductor and the second conductor. The arc runner assembly can be generally stated as including a first arc runner and a second arc runner, with the first and second arc runners are spaced apart from one another. The first arc runner is structured to be situated adjacent a first side of the stationary contact and to communicate an electrical arc away from the stationary contact in a first direction. The second arc runner is structured to be situated adjacent a second side of the stationary contact opposite the first side and to communicate an electrical arc away from the stationary contact in a second direction different than the first direction

BRIEF DESCRIPTION OF THE DRAWINGS

A further understanding of the disclosed and claimed concept can be gained from the following Description when read in conjunction with the accompanying drawings in which:

DESCRIPTION

Figure 1:
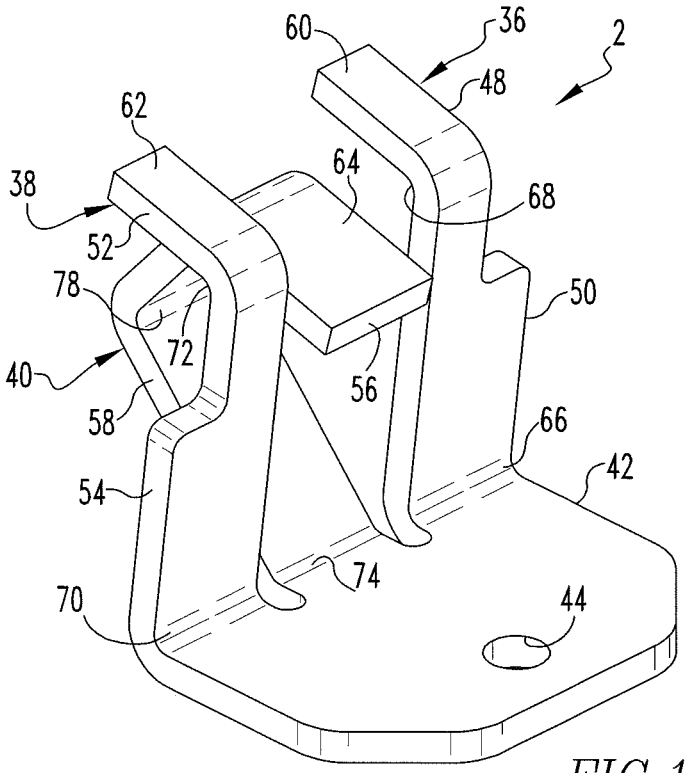
FIG. 1 is a perspective view of an improved arc runner assembly in accordance with the disclosed and claimed concept.
Figure 2:
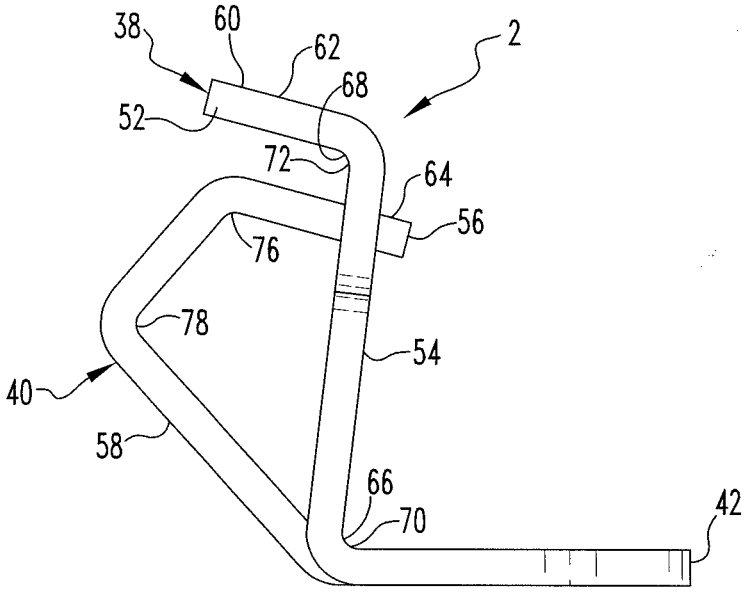
FIG. 2 is a side elevational view of the arc runner assembly of FIG. 1.
Figure 3:
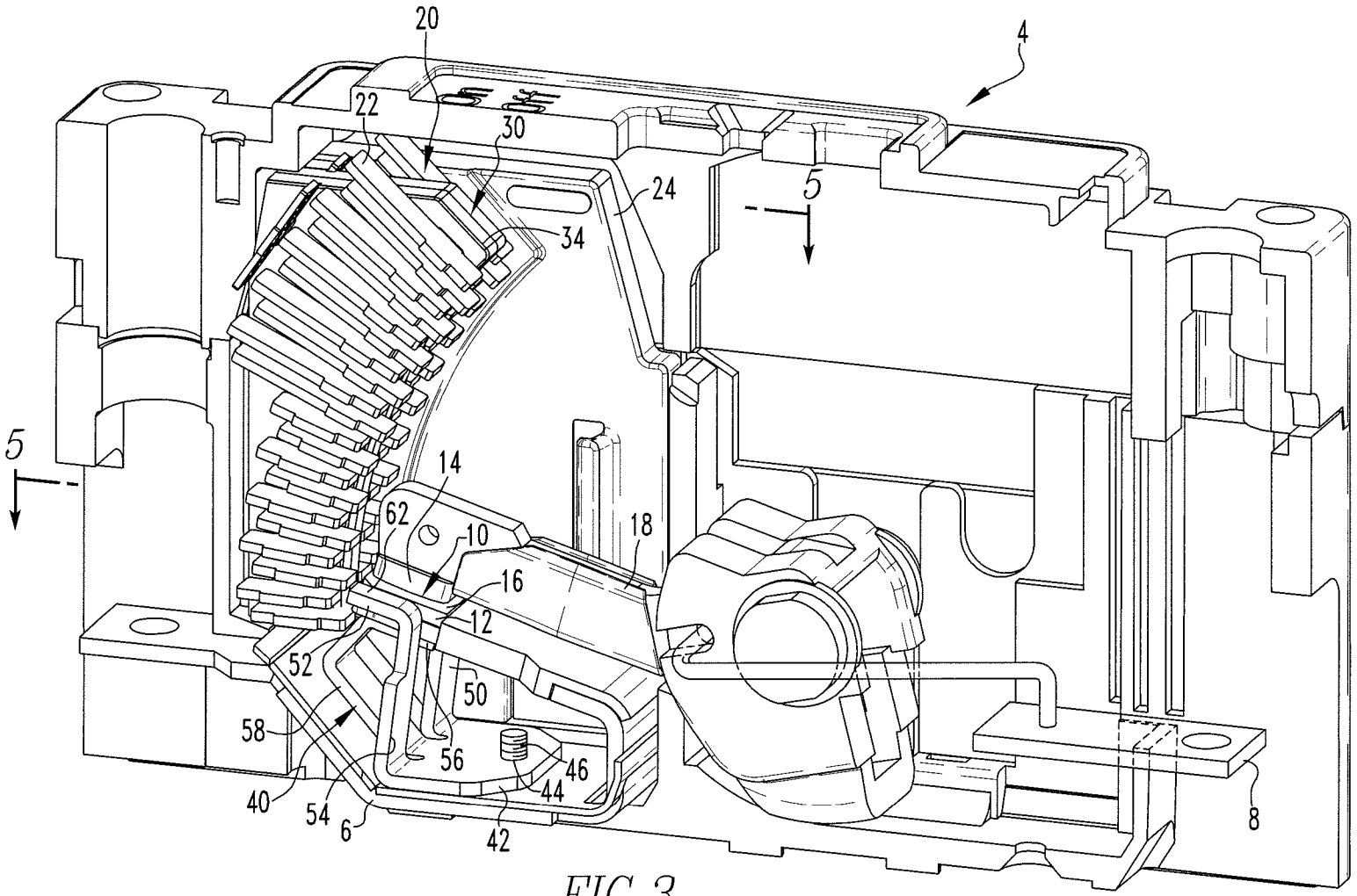
FIG. 3 is a perspective view, partially cut away, of an improved circuit interrupter in accordance with the disclosed and claimed concept that employs the arc runner assembly of FIG. 1.
Figure 4:
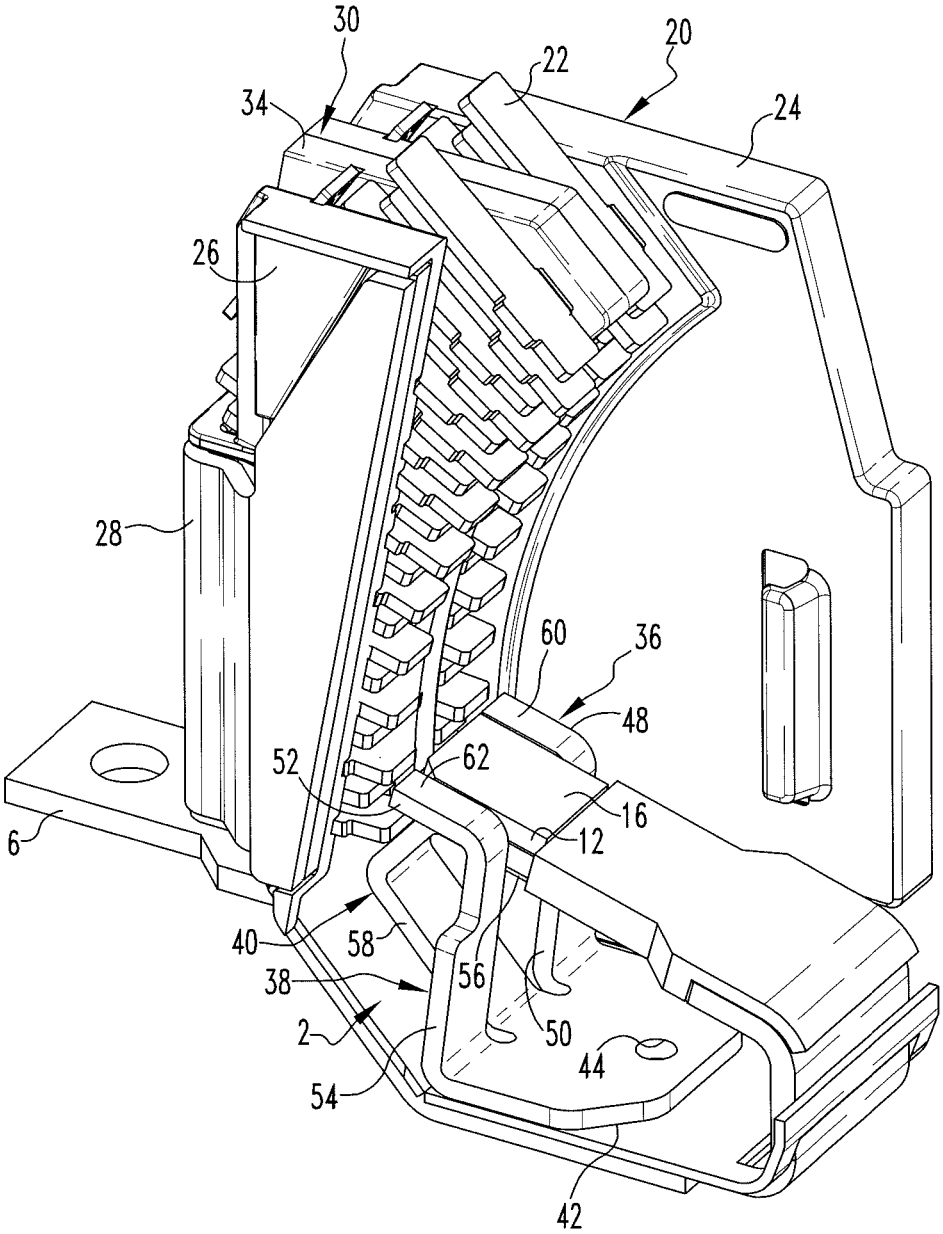
FIG. 4 is a perspective view of a portion of the circuit interrupter of FIG. 3.

An improved arc runner assembly 2 is depicted generally in FIGS. 1 and 2. The arc runner assembly 2 can be employed in a circuit interrupter 4 in accordance with the disclosed and claimed concept, as is depicted generally in FIG. 3 and is depicted in part in FIG. 4. The improved arc runner assembly 2 advantageously enables the circuit interrupter 4 to rapidly extinguish an electrical arc. Arc runner assembly 2 and circuit interrupter 4 are particularly advantageously employed in DC applications but are employable in AC applications without departing from the present concept.

The circuit interrupter 4 can be said to include a first conductor 6, a second conductor 8, and a set of separable contacts 10 that are electrically interposed between the first and second conductors 6 and 8. One of the first conductor 6 and the second conductor 8 will typically be considered a line conductor, and the other of the first and second conductors 6 and 8 will typically be considered a load conductor, although the specific designation is not important herein. The set of separable contacts 10 in the depicted exemplary embodiment include a stationary contact 12 that is depicted as being situated on the first conductor 6. The set of separable contacts 10 further include a movable contact 14 that is situated on a movable contact arm 18 and that is electrically engageable with an engagement surface 16 of the stationary contact 12.

The circuit interrupter 4 further includes an arc extinction apparatus 20 that includes a set of arc plates (collectively indicated at the numeral 22), a first magnet 24, a second magnet 26, and a brace 28. The first and second magnets 24 and 26 are rare earth permanent magnets having their south poles facing toward one another and are held in place by the steel brace 28. The first and second magnets 24 and 26 could alternatively have their north poles facing toward one another without departing from the present concept. It is also expressly noted that the first and second magnets 24 and 26 could be of any form, i.e., whether or not permanent magnets, whether or not formed of rare earth materials or other materials, etc., without departing from the present concept. The arc extinction apparatus 20 further includes an intermediate element 30 that extends midway through the set of arc plates 22 and that includes a steel guide element 32 (FIG. 5) that is covered by a sheath 34 which, in the depicted exemplary embodiment, is formed of a polymer material. As is understood in the relevant art, the circuit interrupter 4 additionally includes an operating mechanism that pivots the contact arm 18 to move the movable contact 14 between positions electrically connected with and electrically disconnected from the stationary contact 12.

As is depicted generally in FIGS. 1 and 2, the arc runner assembly 2 can be said to include a first arc runner 36, a second arc runner 38, a support 40, and a base 42. The arc runner assembly 2 is formed from a plate of stainless steel that is electrically conductive but that does not affect the magnetic fields within the arc extinction apparatus 20 or the other components of the circuit interrupter 4. In the depicted exemplary embodiment, the first and second arc runners 36 and 38 and the support 40 are formed in the arc runner assembly 2 via cutting and bending. In the embodiment depicted herein, the first and second arc runners 36 and 38 and the support 40 each extend from the same end of the base 42. The base itself has a mounting hole 44 formed therein which, in the depicted exemplary embodiment, is threaded to receive therein a threaded fastener 46 (as is depicted generally in FIG. 3) which extends through a molded case component of the circuit interrupter 4 to secure the arc runner assembly 2, the first conductor 6, and other structures within the circuit interrupter 4. It is noted, however, that in other embodiments of the arc runner assembly 2, the mounting hole 44 can accommodate other types of fasteners without departing from the present concept.

The first arc runner 36 can be said to include a first arc runner element 48 situated on a first leg 50. The first leg 50 supports the first arc runner element 48 in a position spaced from the base 42. The second arc runner 38 likewise can be said to include a second arc runner element 52 situated on a second leg 54, with the second leg 54 supporting the second arc runner element 52 in a position spaced from the base 42. The support 40 can be said to include a support element 56 situated on a strut 58, with the strut 58 supporting the support element 56 at a position spaced from the base 42. The first and second arc runners 36 and 38 can be said to be situated on opposite sides of the support 40, and the support 40 can alternatively be said to be situated generally between the first and second arc runners 36 and 38.

The first arc runner element 48 includes a generally planar first arc runner surface 60, and the second arc runner element 52 likewise has a generally planar second arc runner surface 60. The first and second arc runner surfaces 60 and 62 are generally coplanar with one another and with the engagement surface 16 of the stationary contact 12. The support element 56 has a generally planar support surface 64 that is oriented parallel with and offset from the first and second arc runner surfaces 60 and 62, as can be understood from FIGS. 1 and 2. The support surface 64 is structured to be electrically engaged with a surface of the first conductor 60 opposite that upon which the stationary contact 12 is situated. The support 40 engaged with the aforementioned surface of the first conductor 6 supports the first conductor 6 when the contact arm 18 compressively engages the movable contact 14 with the engagement surface 16 of the stationary contact 12. Such supporting engagement also provides the aforementioned electrical engagement between the first conductor 6 and the arc runner assembly 2 which enables an electrical arc that may be formed between the stationary and movable contacts 12 and 14 to be communicated along the first arc runner surface 60 or the second arc runner surface 62 which, in a DC application, depends upon the polarity of the DC that is being interrupted.

As has been suggested elsewhere herein, arc runner assembly 2 is formed by cutting and bending a piece of stainless steel or other appropriate conductive material. The first arc runner 36 can be said to include a proximate bend 66 that is proximate the base 42 and to further include a distal bend 68 that is distal from the base 42. The second arc runner 38 likewise includes proximate bend 70 and further includes a distal bend 72. Support 40 includes proximate bend 74, a distal bend 76, and an intermediate bend 78 situated between the proximate and distal bends 74 and 76. As can be understood from FIGS. 1 and 2, some of the various bends in the first and second arc runners 36 and 38 and the support 40 are generally in the same direction whereas other bend are in opposite directions. For instance, the proximate bends 66, 70, and 74 are all in the same direction as one another, i.e., facing generally toward base 42. However, while the distal bends 68 and 72 are generally in the same direction as one another, i.e., generally away from the base 42, the distal bend 76 is in a direction opposite thereto, i.e., generally toward the base 42. The intermediate bend 78 is in generally the same direction as the distal bend 76. It is noted, however, that the arc runner assembly 2 can be formed in any of a variety of fashions and can have any of a variety of configurations without departing from the present concept.

As can be understood from the foregoing, therefore, the first arc runner surface 60 is situated coplanar with the engagement surface 16 of the stationary contact 12 and is situated at a first side thereof. Likewise, the second arc runner surface 62 is oriented coplanar with the engagement surface 16 and is situated at a second, opposite side of the stationary contact 12. Since the arc runner assembly 2 is electrically connected with the first conductor 6, any arc that is formed between the stationary and movable contacts 12 and 14 could potentially be communicated along either the first arc runner element 48 or the second arc runner element 52 at the first and second arc runner surfaces 60 and 62, respectively, depending upon various factors.

Figure 5:
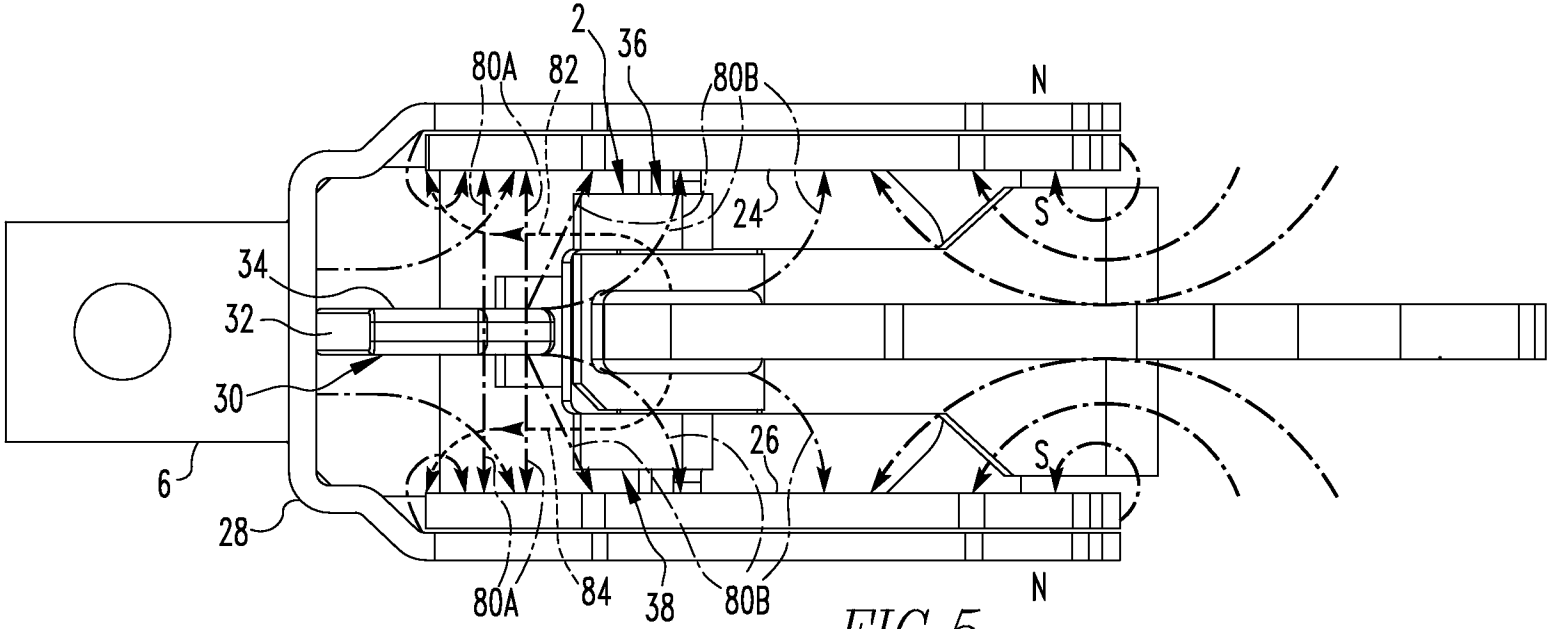
FIG. 5 is a sectional view as taken along line 5-5 of FIG. 3. Similar numerals refer to similar parts throughout the specification.

In the depicted exemplary embodiment, as is indicated generally in FIG. 5, the first and second magnets 24 and 26 are oriented and held in place by brace 28 such that the same magnetic poles face one another. In the depicted exemplary embodiment, the south poles of the first and second magnets 24 and 26 face toward one another, but in other embodiments the north poles could face one another without departing from the present concept.

As is further depicted in FIG. 5, the guide element 32 is electrically connected with the brace 28. The sheath 34 is of a relatively small thickness in comparison with the overall dimensions of the guide element 32 such that the guide element 32 extends expansively within intermediate element 30. Since the south poles of the first and second magnets 24 and 26 face toward one another, and due to the presence of the ferrous and thus magnetic field directing guide element 32 therebetween, the magnetic field lines that exist between the first and second magnets 24 and 26 are represented generally at the numerals 80A and 80B in FIG. 5. Some of the field lines, such as those indicated generally at 80A, extend from the guide element 32 directly toward either the first magnet 24 or the second magnet 26. Other field lines, such as those indicated generally at the numeral 80B, and which emanate from a free end of the guide element 32 opposite its connection with the brace 28, can be said to extend generally outward from the free end of the guide element 32, generally across the first or second arc runner elements 48 and 52, and toward a different location on the first and second magnets 24 and 26, respectively.

According to the well understood Right Hand Rule, the magnetic fields indicated by the field lines 80A and 80B will direct a DC arc along either a first movement direction 82 or a second movement direction 84 depending upon the polarity of the DC arc being interrupted. More particularly, DC current going into the plane of the page of FIG. 5, i.e., from the movable contact 14 toward the stationary contact 12, will be pushed generally along the first movement direction 82, meaning that the DC arc will be communicated along the first arc runner surface 60 of the first arc runner element 48 and then toward the set of arc plates 22. On the other hand, DC current coming out of the plane of the page of FIG. 5, i.e., going from the stationary contact 12 toward the movable contact 14, will be pushed by the magnetic fields in the arc extinction apparatus 20 generally along the second movement direction 84, which means that the arc will be communicated along the second arc runner surface 62 of the second arc runner element 52 and then toward the set of arc plates 22.

It is reiterated that the arc runner assembly 2 and circuit interrupter 4 can be employed in an AC application without departing from the present concept and will achieve similarly beneficial results. However, the first and second arc runner elements 48 and 52 that are situated at opposite sides of the stationary contact 12 very advantageously communicate DC arcs of either polarity along their surfaces toward the arc plates 22 for interruption of such arcs, which is highly advantageous.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An arc runner assembly structured for use in a circuit interrupter having a first conductor, a second conductor, a set of separable contacts electrically interposed between the first conductor and the second conductor, and a magnet apparatus that is structured to generate a magnetic field, the set of separable contacts comprising a stationary contact situated on one of the first conductor and the second conductor, the arc runner assembly comprising:

a first arc runner;

a second arc runner;

the first and second arc runners being spaced apart from one another;

the first arc runner structured to be situated adjacent a first side of the stationary contact and, in the presence of the field and one of a positive DC polarity and a negative DC polarity, is structured to communicate an electrical arc along the first arc runner and to communicate the electrical arc away from the stationary contact in a first direction for extinction; and the second arc runner structured to be situated adjacent a second side of the stationary contact opposite the first side and, in the presence of the field and the other of a positive DC polarity and a negative DC polarity, is structured to communicate an electrical arc along the second arc runner and to communicate the electrical arc away from the stationary contact in a second direction different than the first direction for extinction.

2. The arc runner assembly of claim 1 wherein the arc runner assembly further comprises a base, the first and second arc runners being situated on the base.

3. The arc runner assembly of claim 2 wherein the base has a mounting hole formed therein that is structured to receive a mounting fastener.

4. The arc runner assembly of claim 3 wherein the mounting hole is threaded and is structured to threadably receive the mounting fastener.

5. The arc runner assembly of claim 1 wherein the arc runner assembly further comprises a support that is structured to be electrically engaged with the one of the first conductor and the second conductor at a surface thereof opposite that on which the stationary contact is situated.

6. The arc runner assembly of claim 5 wherein the support is electrically connected with the first and second arc runners.

7. An arc runner assembly structured for use in a circuit interrupter having a first conductor, a second conductor, and a set of separable contacts electrically interposed between the first conductor and the second conductor, the set of separable contacts comprising a stationary contact situated on one of the first conductor and the second conductor, the arc runner assembly comprising:

a first arc runner;

a second arc runner;

the first and second arc runners being spaced apart from one another;

the first arc runner structured to be situated adjacent a first side of the stationary contact and to communicate an electrical arc away from the stationary contact in a first direction;

the second arc runner structured to be situated adjacent a second side of the stationary contact opposite the first side and to communicate an electrical arc away from the stationary contact in a second direction different than the first direction;

wherein the arc runner assembly further comprises a support that is structured to be electrically engaged with the one of the first conductor and the second conductor at a surface thereof opposite that on which the stationary contact is situated;

wherein the support is electrically connected with the first and second arc runners; and wherein the first arc runner comprises a first arc surface, and wherein the second arc runner comprises a second arc surface, the first and second arc surfaces being oriented substantially coplanar, the support having a substantially planar support surface that is structured to be electrically engaged with the one of the first conductor and the second conductor and that is oriented generally parallel with but offset from the first and second arc surfaces.

8. The arc runner assembly of claim 6 wherein the arc runner assembly further comprises a base, the first and second arc runners and the support being situated on the base.

9. An arc runner assembly structured for use in a circuit interrupter having a first conductor, a second conductor, and a set of separable contacts electrically interposed between the first conductor and the second conductor, the set of separable contacts comprising a stationary contact situated on one of the first conductor and the second conductor, the arc runner assembly comprising:

a first arc runner;

a second arc runner;

the first and second arc runners being spaced apart from one another;

the first arc runner structured to be situated adjacent a first side of the stationary contact and to communicate an electrical arc away from the stationary contact in a first direction;

the second arc runner structured to be situated adjacent a second side of the stationary contact opposite the first side and to communicate an electrical arc away from the stationary contact in a second direction different than the first direction;

wherein the arc runner assembly further comprises a support that is structured to be electrically engaged with the one of the first conductor and the second conductor at a surface thereof opposite that on which the stationary contact is situated;

wherein the support is electrically connected with the first and second arc runners;

wherein the arc runner assembly further comprises a base, the first and second arc runners and the support being situated on the base; and wherein the support comprises a support element and a strut, the support element being structured to be electrically engaged with the one of the first conductor and the second conductor, the strut extending between the support element and the base to support the support element at a location spaced from the base.

10. The arc runner assembly of claim 9 wherein at least a first bend is formed in the arc runner assembly between the support element and the base.

11. The arc runner assembly of claim 9 wherein the first arc runner comprises a first arc runner element and a first leg, the first arc runner element being structured to be situated adjacent the first side of the stationary contact, the first leg extending between the first arc runner element and the base to support the first arc runner element at a location spaced from the base, and wherein the second arc runner comprises a second arc runner element and a second leg, the second arc runner element being structured to be situated adjacent the second side of the stationary contact, the second leg extending between the second arc runner element and the base to support the second arc runner element at a location spaced from the base.

12. The arc runner assembly of claim 11 wherein the strut, the first leg, and the second leg each extend from the same end of the base.

13. The arc runner assembly of claim 12 wherein a number of first bends are formed in the arc runner assembly between the first arc runner element and the base, wherein a number of second bends are formed in the arc runner assembly between the second arc runner element and the base, and wherein a number of third bends are formed in the arc runner assembly between the support element and the base.

14. The arc runner assembly of claim 13 wherein at least one of the number of first bends, at least one of the number of second bends, and at least one of the number of third bends are in a common direction.

15. The arc runner assembly of claim 13 wherein at least one of the number of first bends and at least one of the number of second bends are in one direction, and wherein at least one of the number of third bends is in another direction different than the one direction.

16. The arc runner assembly of claim 6 wherein at least a portion of the support is situated generally between the first and second arc runners.

17. An arc runner assembly structured for use in a circuit interrupter having a first conductor, a second conductor, and a set of separable contacts electrically interposed between the first conductor and the second conductor, the set of separable contacts comprising a stationary contact situated on one of the first conductor and the second conductor, the arc runner assembly comprising:

a first arc runner;

a second arc runner;

the first and second arc runners being spaced apart from one another;

the first arc runner structured to be situated adjacent a first side of the stationary contact and to communicate an electrical arc away from the stationary contact in a first direction;

the second arc runner structured to be situated adjacent a second side of the stationary contact opposite the first side and to communicate an electrical arc away from the stationary contact in a second direction different than the first direction; and wherein the set of separable contacts further comprises a movable contact that is structured to engageable with an engagement surface of the stationary contact, wherein the first arc runner comprises a first arc surface, and wherein the second arc runner comprises a second arc surface, the first and second arc surfaces being oriented substantially coplanar with one another and being structured to be oriented substantially coplanar with the engagement surface.

18. A circuit interrupter comprising the arc runner assembly of claim 1, the circuit interrupter further comprising a first conductor, a second conductor, a set of separable contacts electrically interposed between the first conductor and the second conductor, and a magnet apparatus that is structured to generate a magnetic field, the set of separable contacts comprising a stationary contact situated on one of the first conductor and the second conductor and being situated generally between the first arc runner and the second arc runner.

19. A circuit interrupter comprising:

an arc runner assembly comprising:

a first arc runner, a second arc runner, and the first and second arc runners being spaced apart from one another;

a first conductor;

a second conductor;

a set of separable contacts electrically interposed between the first conductor and the second conductor, the set of separable contacts comprising a stationary contact situated on one of the first conductor and the second conductor and being situated generally between the first arc runner and the second arc runner;

the first arc runner being situated adjacent a first side of the stationary contact and being structured to communicate an electrical arc away from the stationary contact in a first direction;

the second arc runner being situated adjacent a second side of the stationary contact opposite the first side and being structured to communicate an electrical arc away from the stationary contact in a second direction different than the first direction; and wherein the set of separable contacts further comprises a movable contact that is structured to engageable with an engagement surface of the stationary contact, wherein the first arc runner comprises a first arc surface, and wherein the second arc runner comprises a second arc surface, the first and second arc surfaces and the engagement surface being oriented substantially coplanar.

20. The circuit interrupter of claim 18, wherein the magnet apparatus comprises a pair of magnets, and further comprising an arc extinction apparatus having a guide element that is formed of a ferrous material, at least a portion of the guide element being situated generally between the pair of magnets.

* * * * *